US006892825B1

(12) United States Patent
Hopson

(10) Patent No.: US 6,892,825 B1
(45) Date of Patent: May 17, 2005

(54) BULLDOZER REAR BLADE MOUNTING APPARATUS

(76) Inventor: Donald G. Hopson, 1905 Old Highway 13, Equality, IL (US) 62934

( * ) Notice: Subject to any disclaimer, the term of this patent is extended or adjusted under 35 U.S.C. 154(b) by 0 days.

(21) Appl. No.: 10/797,250

(22) Filed: Mar. 9, 2004

(51) Int. Cl.[7] ..... E02F 3/815
(52) U.S. Cl. ..... 172/824; 172/811; 37/234
(58) Field of Search ..... 172/810, 811, 815, 172/817, 824, 825, 828, 812, 830; 37/234

(56) References Cited

U.S. PATENT DOCUMENTS 3,648,782 A * 3/1972 Mazzarins ..... 172/821
3,773,116 A * 11/1973 Coontz ..... 172/817
4,006,782 A * 2/1977 Nishino et al. ..... 172/815
4,962,816 A * 10/1990 Imon et al. ..... 172/821
5,899,007 A * 5/1999 Niemela et al. ..... 37/281

* cited by examiner

*Primary Examiner*—Robert E. Pezzuto
*Assistant Examiner*—Alexandra K. Pechhold
(74) *Attorney, Agent, or Firm*—Gary K. Price, Esq.

(57) ABSTRACT

A rear blade mounting apparatus for a bulldozer. The mounting apparatus generally includes a frame that extends from the rear of the body of the bulldozer, the frame including a pair of extending loader arms pivotally connected to the rear of the tractor, and a blade pivotally mounted on free ends of the loader arms, and hydraulic cylinders, or the like, controlled to cause the blade to be positioned in various desired positions.

13 Claims, 5 Drawing Sheets

BULLDOZER REAR BLADE MOUNTING APPARATUS

CROSS REFERENCES TO RELATED APPLICATIONS

None

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a rear blade mounting apparatus for a bulldozer. In particular, the invention relates to a blade apparatus and its control method, which blade is mounted to the rear of the bulldozer such that the rear blade can be operated in lift or tilt modes.

2. Brief Description of Prior Art

In the construction industry, labor and capital equipment costs are primary variables that effect the cost of a particular project. Large machinery is used to more efficiently handle tasks that were originally accomplished by hand, such as digging, lifting, and moving objects. For example, bulldozers are commonly used on construction job sites for digging, pushing and removing large amounts of earth for mining, grading and other tasks.

A bulldozer is typically a tractor-like machine having a forwardly mounted bucket that extends forward of the body of the bulldozer. The bulldozer further includes a pair of extending loader arms pivotally connected to the tractor, and said bucket pivotally mounted on free ends of the loader arms. Hydraulic cylinders, or the like, are mounted on the loader arms and controlled to cause the bucket to be positioned in various desired positions. The bucket can be lifted over the body or placed on the ground. Further, the orientation of the bucket can be controlled to hold dirt or the like or to dump the same.

The rear of the tractor may include an attachment that trails the body of the bulldozer such as a ripper, or a winch, or the rear of the tractor may not include any such accessory.

While these tractors in general, are effective in collecting and removing earth, especially large chunks of earth, these tractors have some limitations. In particular, a conventional bulldozer having said forwardly mounted bucket when collecting and removing earth from a mine pit for example, cannot pivot so that the bucket will collect the fine material remaining at or near the walls of such pit. Depending upon the size of the pit, there are often large volumes of such materials remaining. Often such remaining material must be shoveled by hand into a dump truck for transporting away. Such manual procedure requires additional manpower which is not only dangerous due to such manpower working near large machinery, but also costly, time consuming, and generally inefficient. The inventor herein is unaware of any attachment to the bulldozer available for collecting such materials at or near the walls of the mine pit work site.

As will be seen from the subsequent description, the preferred embodiments of the present invention overcome these and other shortcomings of prior art.

SUMMARY OF THE INVENTION

The present invention is designed to be mounted to the rear of a bulldozer that will effectively access and make collectable materials such as fine material remaining at or near the walls of a mine pit for example, that the front-end bucket of the bulldozer is unable to access. The preferred embodiment generally includes a frame that extends from the rear of the body of the bulldozer, said frame including a pair of extending loader arms pivotally connected to the rear of the bulldozer, and a blade pivotally mounted on free ends of the loader arms, and hydraulic cylinders, or the like, controlled to cause the blade to be positioned in various desired positions.

DESCRIPTION OF THE PREFERRED EMBODIMENT

Figure 1:
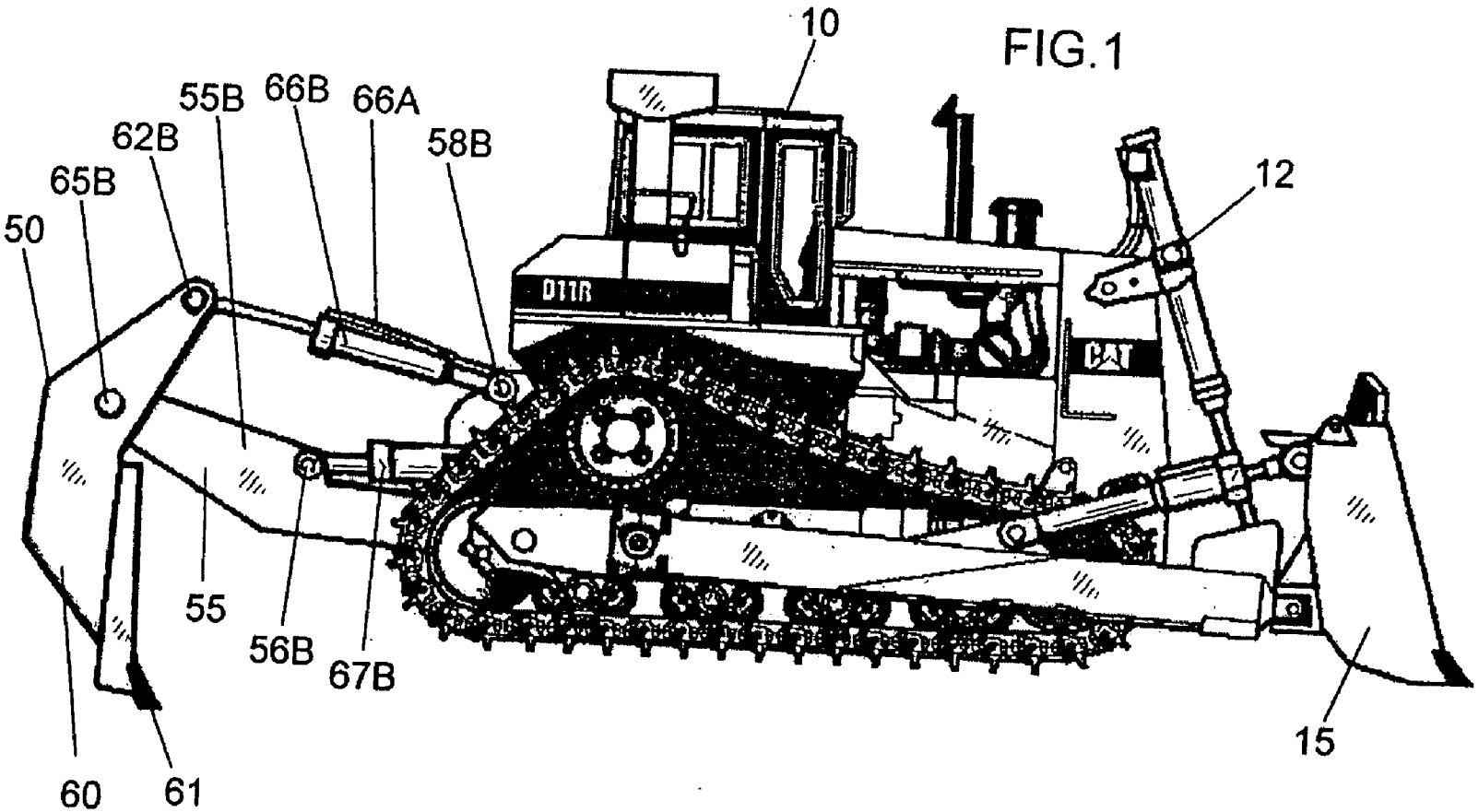
FIG. 1 is a side view of a bulldozer having rearwardly mounted the preferred embodiment of the present invention, where the blade is in a first position.
Figure 2:
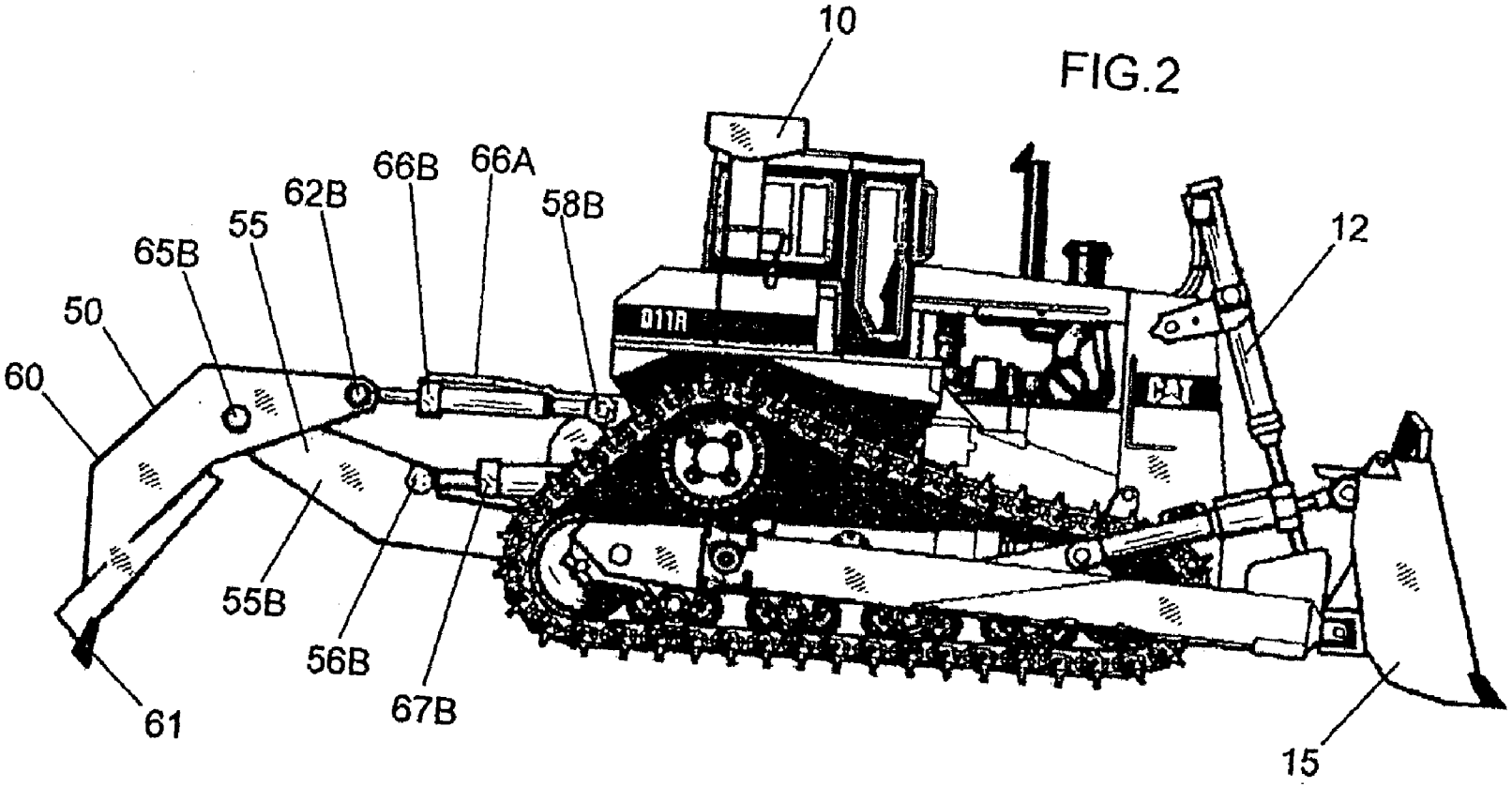
FIG. 2 is a side view of the bulldozer of FIG. 1 where the blade is in a second position.

FIGS. 1–5 illustrate a preferred embodiment of a bulldozer rear blade mounting structure 50 made in accordance with the present invention. With reference to FIGS. 1–2, a common bulldozer tractor 10 (also referred to as a tractor 10) having the prior art forwardly mounted bulldozer structure 12 having a bucket 15 secured to the front of the tractor 10 is disclosed.

Figure 3:
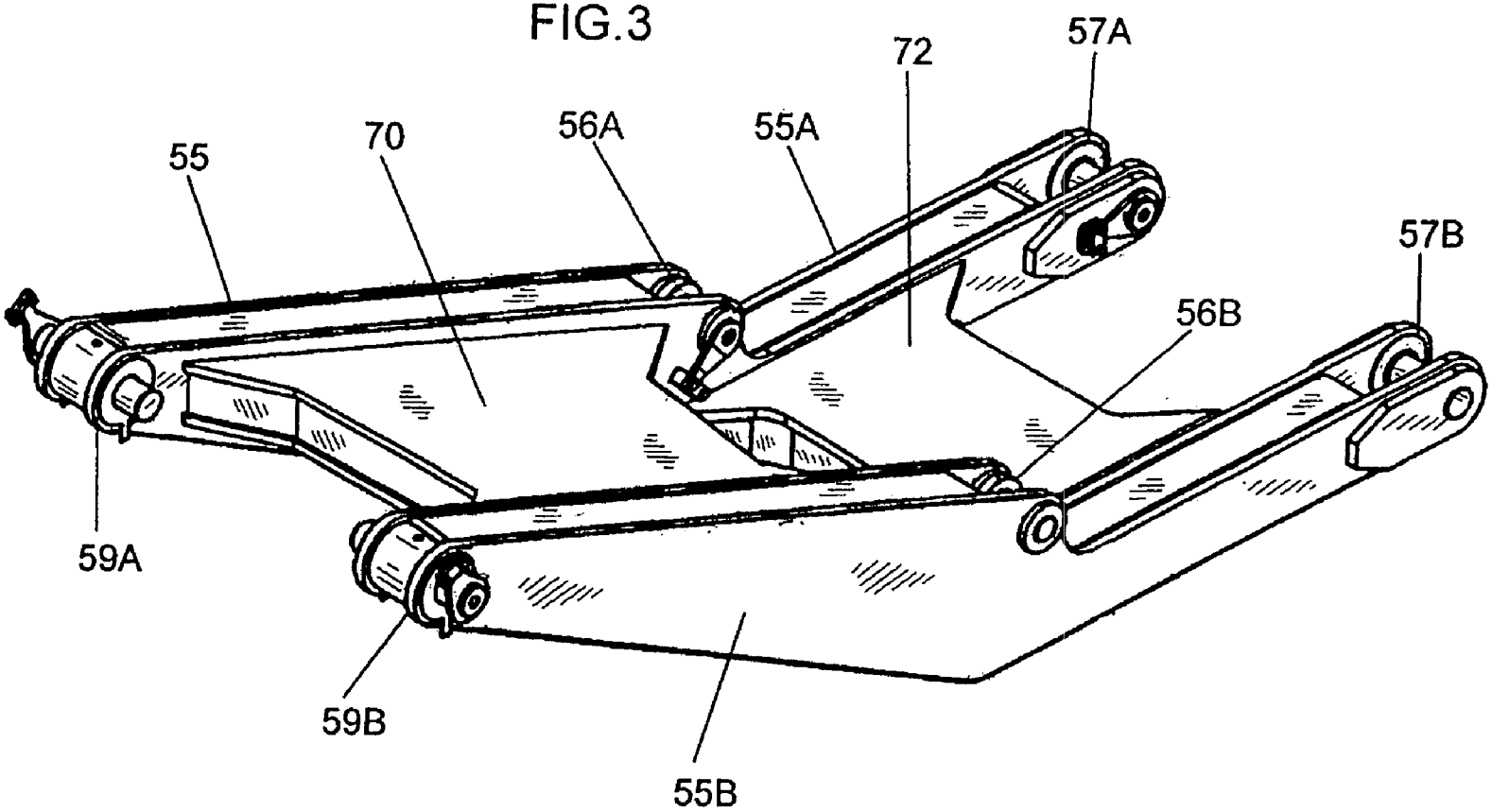
FIG. 3 illustrates a perspective view of the frame of the present invention.
Figure 4:
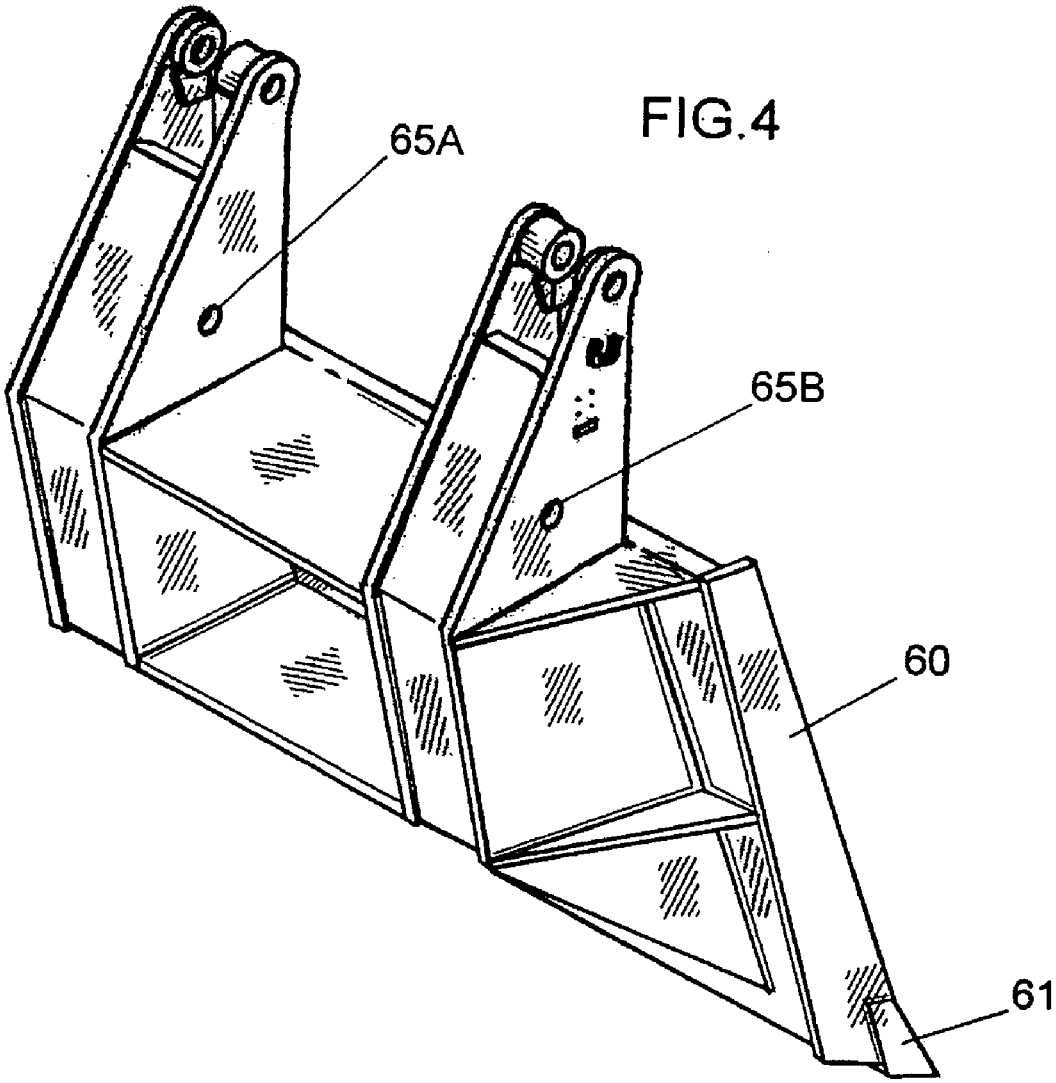
FIG. 4 illustrates a perspective view of the blade of the present invention.

As shown in FIGS. 1–2, attached to the rear of the tractor 10 is the rear blade mounting structure 50 made in accordance with the present invention. The structure 50 includes a frame 55, said frame 55, as best shown in FIG. 3, having first and second support arms 55A and 55B. The support arms 55A and 55B extend from the rear of the body of the tractor 10 and is pivotally mounted to the rear of the body of the tractor 10 in a manner using, connecting pivot points 57A (not shown) and 57B (shown in FIG. 5). The opposite ends of support arms 59A and 59B of the support arms are coupled to midway end portions 65A and 65B of the inside of a blade 60. The blade 60 having a blade edge member 61 and including upper end portions 62A (not shown) and 62B disposed at the approximate upper end of the blade 60 at opposing right and left ends thereof. The midway end portions 65A and 65B disposed at the approximate midway of the blade 60 at opposing right and left ends thereof. The blade 60 having a substantially rectangular configuration.

At the approximate midway of each of said arms 55A and 55B is disposed coupling joints 56A and 56B that attach to a pair of upper hydraulic cylinders 66A and 66B and a pair of lower hydraulic cylinders 67A (not shown) and 67B as will be further described.

Referring again to FIG. 3, the frame 55 further including support plates 70 and 72 disposed between support arms 55A and 55B, the plates 70 and 72 provided to support the functional elements of the frame 55.

The rear of the tractor 10 having pairs of upper and lower end joints 58A (not shown), 58B and 58C (not shown), 58D, respectively, for attaching the hydraulic cylinders 66A, 66B and 67A and 67B. Specifically, the upper hydraulic cylinders 66A and 66B are removably and pivotally installed to the upper end joints 58A and 58B of the rear of the tractor 10; and the lower hydraulic cylinders 67A and 67B are removably and pivotally installed to the lower end joints 58C and 58D of the rear of the tractor 10. The other end of the pair of upper hydraulic cylinders 66A and 66B removably and pivotally attached to the upper end portions 62A and 62B of the inside of the blade 60; and the other end of the pair of lower hydraulic cylinders 67A and 67B removably and pivotally attached to the coupling joints 56A and 56B of the support arms 55A and 55B. The attachment are of a conventional manner known in the art.

As shown in the drawings, said upper hydraulic cylinders 66A and 66B being longer than the lower hydraulic cylinders 67A and 67B in order to further extend the blade 60 from the tractor 10 and to give sufficient clearance between the blade 60 and the tractor 10. As should be obvious, as a result of the extended length of the upper hydraulic cylinders 66A and 66B, and as a result of said cylinders 66A and 66B being pivotally attached to the upper end portions 62A and 62B at the approximate upper end of the blade 60, the blade 60 is able to be positioned higher than the standard forwardly mounted bucket 15.

As should be appreciated from the description herein, the rear blade mounting structure 50 is symmetrically constructed with pairs of elements on opposite sides of the tractor 10. As such, only the elements found on one side of the tractor 10 is primarily discussed and shown in the FIGS. 1–2. It should be understood that the other set of elements are identical to those described, with the exception that the other set of elements are mirror images of the first set of elements described.

The application of the rear blade mounting structure 50 is generally operating means used for the conventional forwardly mounted bulldozer structure 12 known in the art.

In use, as shown in FIG. 2, the blade 60 may be moved substantially vertically by rotating the frame 55 about pivot arm 57B and the blade 60 can be rotated about pivot point 65B which forms a substantial horizontal axis.

Starting with the blade 60 in the position in FIG. 1, the user can retract upper cylinder pair 66A, B to raise the blade 60 to the position shown in FIG. 2. This position allows the user to position the blade 60 above a pile of material to be moved. Once in position the user can extend cylinder pair 67A, B to drop the frame 55 and extend cylinder pair 66A, B to achieve a third position shown in FIG. 5. In this position, the blade edge 61 can dig in and by pulling the whole tractor 10 forward material in front of the blade 60 can be pulled forward.

With regard to rotation about a substantially horizontal axis, the user adjusts the blade 60 by selectively extending or retracting the upper hydraulic-cylinders 66A and 66B, and the lower hydraulic cylinders 67A and 67B. When said cylinders 66A, 66B and 67A, 67B are telescopically adjusted such to be shorter or longer, the blade 60 is shifted and rotates about said substantially horizontal axis.

If the user wishes the blade 60 to be oriented at a selected angle with respect to the longitudinal axis of the tractor 10 (as shown in FIGS. 1–2), the user extends either the upper hydraulic cylinders 66A and 66B or the lower hydraulic cylinders 67A and 67B until the blade 60 is at the desired orientation.

Figure 5:
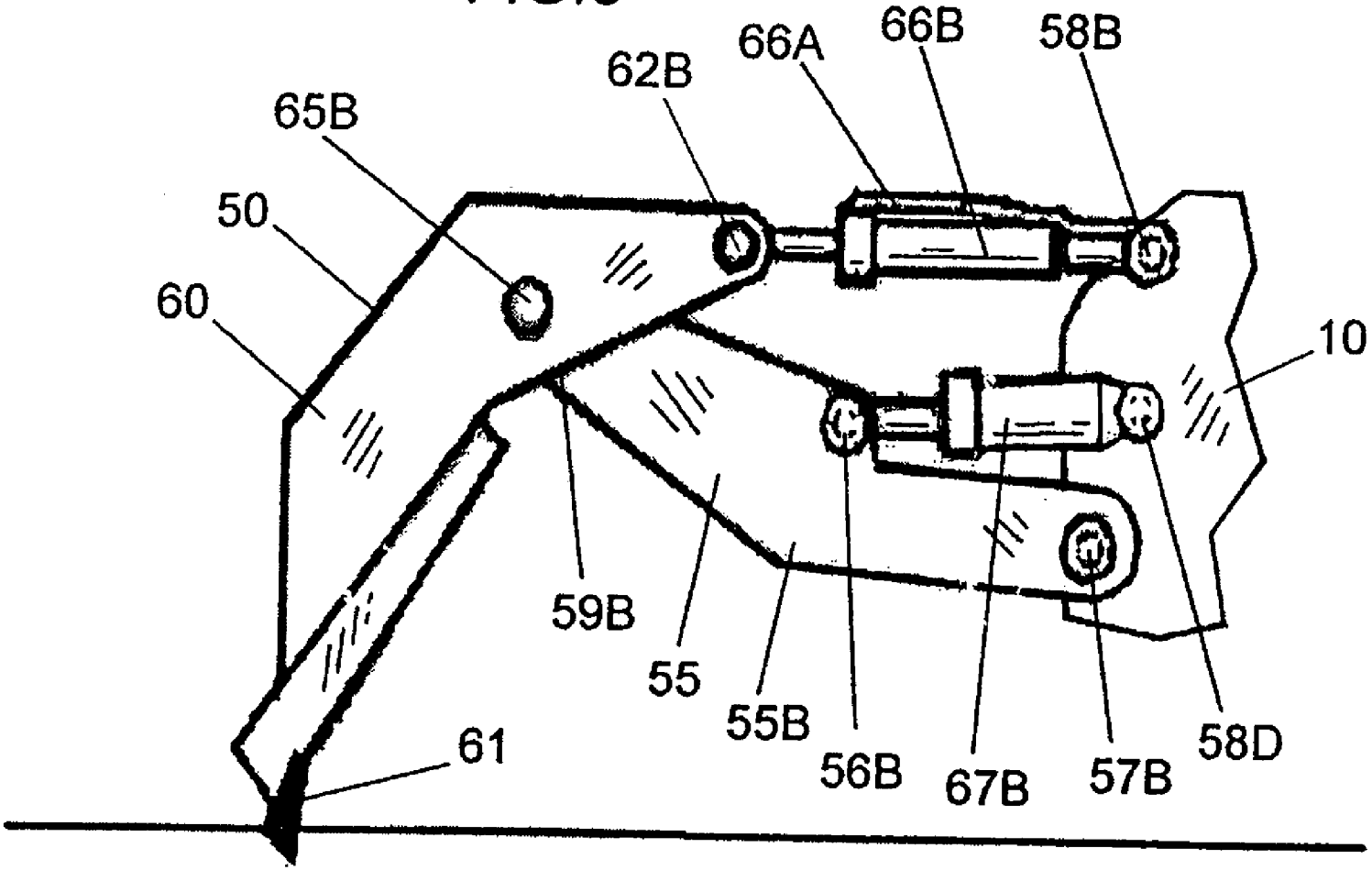
FIG. 5 illustrates a partial view of the bulldozer with the blade in a third position.

In the configuration of the present invention, the tractor 10 uses the forwardly mounted bulldozer bucket 15 to collect and remove earth, from a mine pit work site for example. When the bucket 15 cannot pivot so that the bucket 15 will collect the fine material at or near the walls of such pit generally on an ascending slope, the user utilizes the rear blade mounting structure 50 mounted to the rear of the tractor 10 to move such material so that the forwardly mounted bucket 15 is then able to collect and remove such material. Specifically, the operator raises the upper hydraulic cylinders 66A and 66B causing the blade 60 to rotate as shown in FIG. 2, so that the blade 60 is positioned above the said material to be moved and on the approximate same vertical axis as the said wall of the pit. The operator then lowers the upper hydraulic cylinders 66A and 66B causing the blade edge member 61 of the blade 60 to lower and dig into the earth material as shown in FIG. 5. Once the blade 60 is lowered to a selected depth, the operator then drags the material by driving the tractor 10 in the direction away from the wall of the pit while the blade 60 is dug into the material. As a result, the blade 60 moves that material in contact with the blade 60, that material approximately between the blade 60 and the rear of the tractor 10. It has been found that such material should be moved the approximate length of the body of the tractor 10 in order to make available to the bucket 15 for collection. Once moved, such material is then accessible to the bucket 15 and is collected and removed by the bucket 15 on the front of the tractor 10 in a conventional manner.

Although the description above contains many specificities, these should not be construed as limiting the scope of the invention but as merely providing illustrations of a presently preferred embodiment of this invention.

Though not shown, it would be possible to mount the upper cylinder pair 66A, B with pivot point 55B on the top edge of the frame 55 instead of on the tractor 10. Such an arrangement would still allow the upper cylinder pair 66A, B to pivot the blade 60 about pivot point 65A, B to control the position of the blade 60 about the axis defined by pivot points 65A, B.

Thus the scope of the invention should be determined by the appended claims in the formal application and their legal equivalents, rather than by the examples given.

I claim:

1. A rear blade mounting apparatus designed to be mounted to the rear of a bulldozer, said mounting apparatus comprising:

a frame having first and second support arms, said first and second support arms pivotally mounted to a rear portion of said bulldozer, a blade having first and second upper end portions disposed adjacent an upper edge of the blade at opposite ends of said blade, and first and second midway pivot points adjacent to a midway portion of the blade, said blade pivotally attached to an end of said frame, at least one upper hydraulic cylinder wherein one end of the at least one upper hydraulic cylinder is pivotally attached to the rear portion of said bulldozer, and an opposite end of the at least one upper hydraulic cylinder is pivotally attached to said upper edge of said blade, a pair of lower hydraulic cylinders wherein one end of each of the lower hydraulic cylinders is pivotally attached to the rear portion of said bulldozer below the at least one upper hydraulic cylinder, and opposite ends of the lower hydraulic cylinders are pivotally attached to the frame, and operating means to control the at least one upper hydraulic cylinder and lower hydraulic cylinders.

2. The rear blade mounting apparatus as recited in claim 1, wherein the at least one upper hydraulic cylinder and lower hydraulic cylinders telescopically extend and retract for selective positioning of the blade.

3. A rear blade mounting apparatus designed to be mounted to the rear of a bulldozer body, said mounting apparatus comprising;

a frame having at least a first support arm, said first support arm pivotally mounted to a rear portion of said bulldozer, a blade having at least a first upper end portion disposed adjacent an upper edge of the blade, and first and second midway pivot points adjacent to a midway portion of the blade, said blade pivotally attached to an end of said frame, at least one upper hydraulic cylinder, wherein one end of the upper hydraulic cylinder is pivotally attached to the rear portion of said bulldozer, and an opposite end of the upper hydraulic cylinder is attached to said upper edge of said blade, a pair of lower hydraulic cylinders wherein one end of each of the lower hydraulic cylinders is pivotally attached to the rear portion of said bulldozer below the upper hydraulic cylinder, and opposite ends of the lower hydraulic cylinders are pivotally attached to the frame, and operating means to control the upper hydraulic cylinder and the pair of lower hydraulic cylinders.

4. The rear blade mounting apparatus as recited in claim 3, wherein the upper cylinder and the pair of lower cylinders telescopically extend and retract for selective positioning of the blade.

5. The rear blade mounting apparatus as recited in claim 4, wherein extending the upper cylinder pivots the blade relative to the frame and extending said pair of lower cylinders pivots the frame relative to the bulldozer.

6. The rear blade mounting apparatus as recited in claim 5, wherein said blade has a width approximately equal a width of said bulldozer and wherein said blade is substantially a flat plate with a blade edge adjacent a bottom of said blade.

7. A combination bulldozer and rear blade mounting apparatus for mounting a blade on a rear portion of a bulldozer body, said combination comprising:

said bulldozer including a bucket on the front thereof, said bucket having a width, a frame pivotally mounted to a rear portion of said bulldozer, a blade having an upper edge and a lower edge and said blade pivotally attached to an end of said frame opposite said bulldozer, at least one upper hydraulic cylinder wherein one end of the upper hydraulic cylinder is pivotally attached adjacent to the rear portion of said bulldozer, and an opposite end of the upper hydraulic cylinder is attached to said upper edge of said blade, a lower hydraulic cylinder wherein one end of the lower hydraulic cylinder is pivotally attached to the rear portion of said bulldozer below the upper hydraulic cylinder, and an opposite end of the lower hydraulic cylinder is pivotally attached to the frame, and operating means to control the upper hydraulic cylinder and the lower hydraulic cylinder.

8. The combination as recited in claim 7, including a second upper hydraulic cylinder mounted parallel to said upper hydraulic cylinder.

9. The combination as recited in claim 8, including a second lower hydraulic cylinder mounted parallel to said lower cylinder.

10. The combination as recited in claim 7, wherein extending the upper cylinder pivots the blade relative to the frame and extending said lower cylinder pivots the frame relative to the bulldozer.

11. The combination as recited in claim 10, wherein said blade has a width approximately equal a width of said bulldozer and wherein said blade is substantially a flat plate with a blade edge adjacent a bottom of said blade such that extending said lower cylinder will place the blade edge on the ground in a horizontal orientation.

12. The combination as recited in claim 10, wherein said blade has a width effectively equal to the width of said front bucket.

13. The combination as recited in claim 10, wherein the one end of said upper hydraulic cylinder is attached to said frame.

* * * * *